US009905388B2

(12) United States Patent
Edmonds

(10) Patent No.: US 9,905,388 B2
(45) Date of Patent: Feb. 27, 2018

(54) DOUBLE-THROW SWITCH FOR BREAKER BOX

(71) Applicant: Elmer Edmonds, Fredericksburg, VA (US)

(72) Inventor: Elmer Edmonds, Fredericksburg, VA (US)

( * ) Notice: Subject to any disclaimer, the term of this patent is extended or adjusted under 35 U.S.C. 154(b) by 0 days.

(21) Appl. No.: 14/999,782

(22) Filed: Jun. 27, 2016

(65) Prior Publication Data

US 2017/0372860 A1 Dec. 28, 2017

(51) Int. Cl.

| | |
|---|---|
| ***H01H 9/26*** | (2006.01) |
| ***H01H 13/72*** | (2006.01) |
| ***H01H 13/76*** | (2006.01) |
| ***H01H 71/10*** | (2006.01) |

(52) U.S. Cl.

CPC ... *H01H 71/1018* (2013.01); *H01H 2300/018* (2013.01)

(58) Field of Classification Search

CPC ..... H01H 71/1018; H01H 2300/018; H01H 2071/10; H01H 2071/1009; H01H 9/20; H01H 9/26; H01H 13/72; H01H 13/76; H01H 3/00; H01H 3/02; H01H 3/04; H01H 3/54; H01H 71/00; H01H 71/02; H01H 71/0214; H01H 71/0264; H01H 71/10; H01H 71/50

USPC .... 200/5 B, 333, 43.01, 43.11, 43.14–43.16, 200/43.19, 43.22, 50.32

See application file for complete search history.

(56) References Cited

U.S. PATENT DOCUMENTS 5,648,646 A * 7/1997 Flegel ..... H01H 9/26 200/50.32

6,541,719 B1 * 4/2003 Powell ..... H01H 71/1018 200/50.32

* cited by examiner

*Primary Examiner* — Anthony R. Jimenez

(74) *Attorney, Agent, or Firm* — Thomas Wallen, P.E., Attorney at Law, L.L.C.

(57) ABSTRACT

A first breaker is adapted to be connected to an external source of electrical power, and a second breaker is adapted to be connected to an electrical generator. The first breaker is in an on position when the second breaker is in an off position, and the first breaker is in an off position when the second breaker is in an on position. The breakers are in combination with a toggle adapted to simultaneously operate the first breaker and the second breaker. The first breaker has a first breaker hole, and the second breaker has a second breaker hole, where the first breaker electrically connects an external power transmission to a breaker box, and the second breaker electrically connects a generator to the breaker box. The toggle comprising an integral bar with a first toggle hole through the toggle, and a second toggle hole through the toggle, such that the first toggle hole and the second toggle hole are longitudinally spaced whereby the first toggle hole registers with the first breaker hole while the second toggle hole registers with the second breaker hole. A first bolt extends through both the first toggle hole and the first breaker hole, and a second bolt extends through the second toggle hole and the second breaker hole, such that when the first breaker is turned to an on position, the toggle simultaneously turns the second breaker to an off position, and when the first breaker is turned to an off position, the toggle simultaneously turns the second breaker to an on position.

4 Claims, 3 Drawing Sheets

DOUBLE-THROW SWITCH FOR BREAKER BOX

CROSS REFERENCE TO RELATED APPLICATIONS

None

STATEMENT REGARDING FEDERALLY SPONSORED RESEARCH OR DEVELOPMENT

Not Applicable

THE NAMES OF PARTIES TO A JOINT RESEARCH AGREEMENT

None

INCORPORATION-BY-REFERENCE OF MATERIAL SUBMITTED ON A COMPACT DISK

None

BACKGROUND OF THE INVENTION

The present invention is directed to linkages for controlling switches and more particularly to a linkage for use as a double throw switch for controlling two switches mounted in the same enclosure so that only one switch can be on at any given time.

It is of paramount importance that emergency generators be insulated from the incoming electric transmission source when the incoming power source is dead. These generators are commonly found in the home, and are often connected to a 30 amp device such as an electric dryer. If the breaker connecting the external electric transmission, i.e. the power company, be in an "on" position at the same time as the emergency generator delivers power to the home, an extremely dangerous situation exists. Under this condition, even though the utility power line is disconnected from the external power source, i.e. the utility company, the emergency generator nonetheless places a dangerous voltage on the power line. Serious injuries and death from electrocution have occurred as a result of a homeowner's emergency generator transmitting power from the home through the power line, for example when a utility operator was working on the transmission line following storm damage. Accidents occur when the utility worker believes the transmission line is dead from the utility source, and shows no voltage, but the homeowner un-expectantly activates the generator.

Switching apparatus generally referred to as a double throw switch is commonly used to alternately connect one of two load devices to a source of electric power or to connect a single load device alternately to one of two separate sources of electric power. One example would be two lines coming into a switch tied to one load coming out of the switch as in a system that has an emergency power generator to switch from normal power source to the emergency generator. Another example is one line coming into a switch tied to two loads coming out of the switch as in a system that has a backup pump that needs to operate when the main pump is off line. The two switch mechanisms are tied together with a linkage. The linkage allows only one switch to be turned on at any given time. Prior linkages typically are assembled using multiple slots in a plate which is secured to a framework by multiple fasteners or rivets which slide in the plurality of slots.

There is a need for a double throw switch linkage that requires fewer parts for assembly thereby reducing costs and complexity.

U.S. Pat. No. 6,815,623, issued to Holland, discloses a double throw switch linkage for coupling two switch apparatuses together in an enclosure. Each switch apparatus is coupled to the switch mechanism having a switch mechanism lever arm. The double throw switch linkage comprises an interlock housing, with the interlock housing defining a pair of actuator plate slots and a first orifice and a second orifice. Each orifice is configured to provide unimpeded passage of each switch mechanism lever arm. An actuator plate is slidingly mounted in the actuator plate slots. The actuator plate is free floating in the interlock housing. The actuator plate defines a first switch slot, a second switch slot, and a driver arm slot. Each switch slot is configured to guide a pin mounted on each switch mechanism lever arm. A lever arm assembly is mounted on a sidewall of the enclosure with the lever arm assembly including a lever arm coupled to a driver arm. The driver arm is configured to engage the driver arm slot and the actuator plate. When the lever arm is moved it translates a force to the actuator plate which closes one switch mechanism and maintains the other switch mechanism in an open position.

U.S. Pat. No. 6,872,900 to Lament et al. discloses a double throw switch linkage for coupling two switch apparatuses together in an enclosure. Each switch apparatus is coupled to the switch mechanism having a switch mechanism lever arm. When the lever arm is moved it translates a force to the actuator plate which closes one switch mechanism and maintains the other switch mechanism in an open position.

U.S. Pat. No. 8,022,319 issued to Lament et al. discloses a switch that comprises a handle operator linkage for a double throw switching apparatus. A handle operator linkage has a lever arm connected to a mid-section, and wherein a stem section connects a base to the mid-section with a pivot hole and at least one first bump facing the base section. The base section has a back bump, which faces the at least one first bump, and thereby forming the handle operator linkage for a double throw switching apparatus.

None of these prior solutions provides a simple, reliable and cost effective double-throw switch. One problem inherent with the above double throw toggles is that the cover for the normal breaker box cannot be closed.

BRIEF SUMMARY OF THE INVENTION

When a emergency generator is used in a location, a generator breaker panel is separately installed and fed by the homeowner's breaker panel. Those circuits that are powered by the generator are isolated from the house panel and installed in the generator panel. Power from the utility company is fed through the house panel and to the generator panel. Under normal operating conditions the breaker in the generator panel connecting the emergency generator is in the "off" position, when the source of the power is external, i.e. the utility company. Under emergency conditions, the breaker in the generator panel connecting the emergency generator is in the "on" position, and the breaker that feeds the external power source is in the "off" position.

The generator panel feeds only those loads in the house that are connected to the generator panel. When the external power source again becomes available, those loads in the house connected to the generator panel remain fed by the emergency generator. Loads connected to the house panel remain connected to the house panel irrespective of whether the emergency generator is connected or not. By utilizing a separate generator panel only those loads that the generator can power will be connected to the generator panel, and the generator will never be overloaded. Also, when the generator is operating, the user will not have to turn off loads on the house panel that the generator does not have the capacity to power.

Applicant discloses a simple integral switching apparatus generally referred to as a double throw switch. The double throw switch is used to connect one of two load devices to a source of electric power or to connect a single load device alternatively to one of two separate sources of electric power. The device can be installed in any conventional breaker box to safely accommodate two separate sources of power or switching apparatus for two load devices.

DETAILED DESCRIPTION OF THE INVENTION

Figure 1:
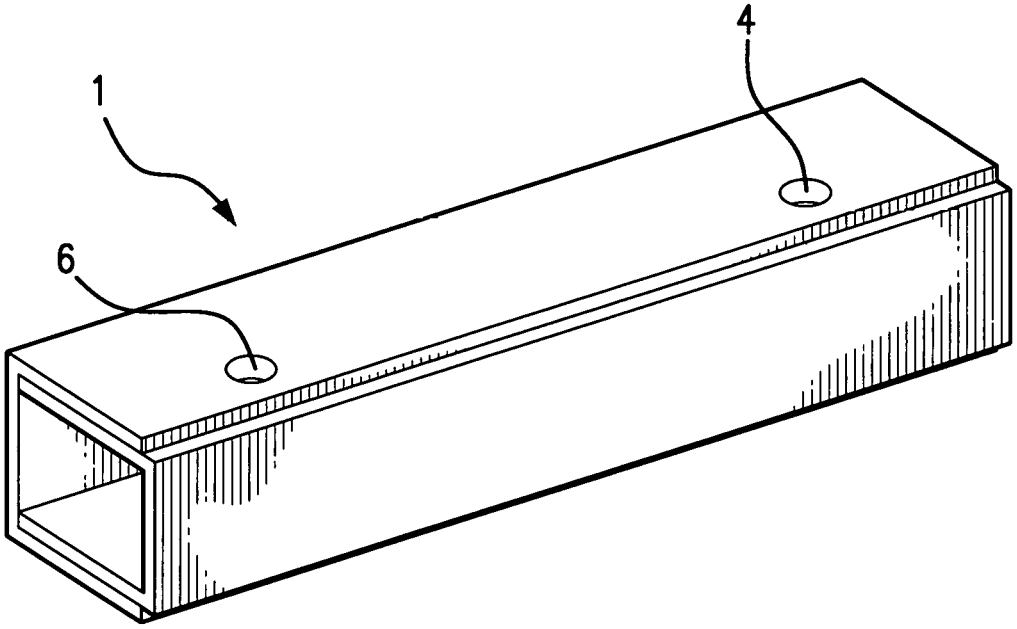
FIG. 1 shows the device according to the invention. The device is an integral or one-piece toggle bar made of a suitable metal or synthetic polymeric material.
Figure 2:
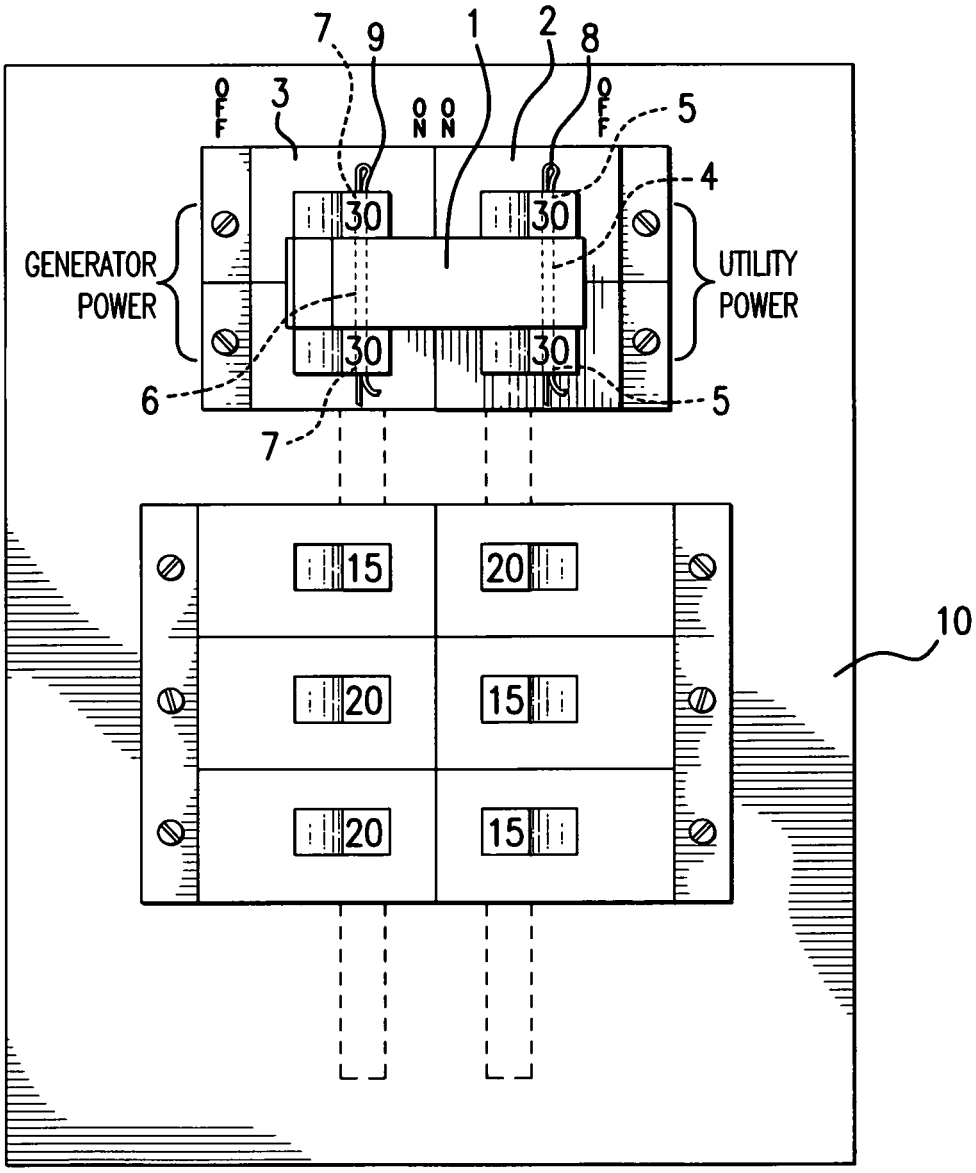
FIG. 2 shows the device according to the invention assembled into a generator breaker box where the generator is in an "on" mode.
Figure 3:
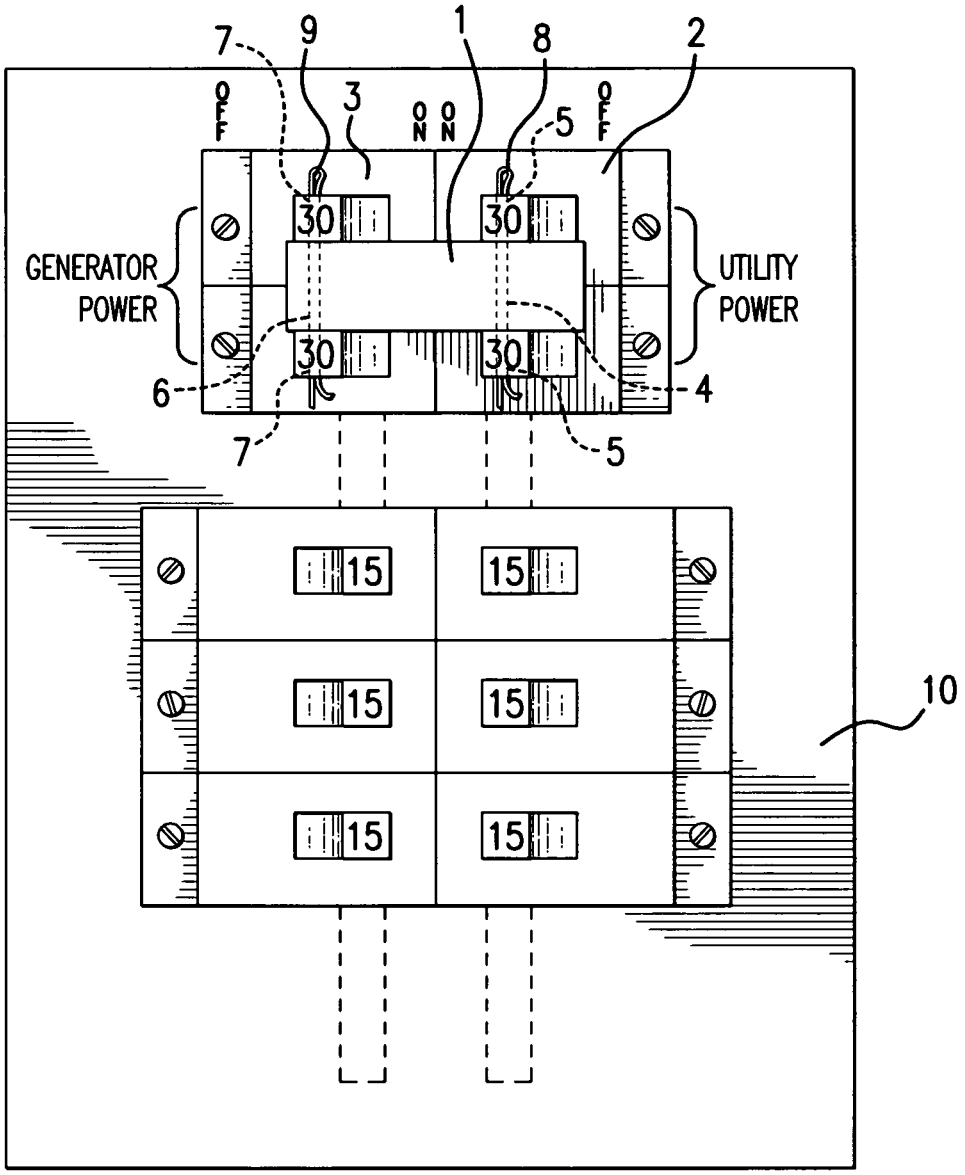
FIG. 3 shows the device according to the invention assembled into a generator breaker box where the generator is in an "off" mode.

The invention is best described in reference to the drawings. FIG. 1 shows the toggle bar (1) of the instant invention. The toggle bar (1) is one-piece of suitable metal or synthetic polymer. The toggle bar (1) is dimensioned to fit between a pair of 30 amp double breakers provided inside the conventional home generator breaker box. According to the invention the generator breaker box is electrically connected to the home breaker box. As best seen in FIG. 2 and FIG. 3, first 30 ampere breaker bar (2) disconnects, or turns off the external power source, i.e. the utility electric transmission, while the other 30 ampere breaker bar (3) turns on the emergency generator. It must be understood that the external utility transmission of power is fed through the home breaker box to the generator breaker box. By arranging the two breaker boxes in this way, the external utility power transmission can remain electrically connected to every load in the home when the emergency generator is not functioning. Only those loads electrically connected to the emergency generator power source through the generator breaker box can be independently powered by the generator.

The following disclosures of FIG. 2 and FIG. 3 refer to the home breaker box. First toggle hole (4) is dimensioned to register with first breaker holes (5) and second toggle hole (6) is dimensioned to register with and second breaker holes (7). As can be readily seen in FIG. 2 and FIG. 3, first breaker holes (5) are located on the outer terminal end of a pair of 15 amp breakers that toggle together, providing a 30 ampere current. First toggle bolt (8) extends through first toggle hole (4) and axially links first toggle hole (4) to first breaker holes (5). Simultaneously second toggle bolt (9) extends through second toggle hole (6) and axially links second breaker holes (7). Bolts (8) and (9) are sized in diameter to provide a sliding fit with first breaker holes (5) and second breaker holes (7). Bolts (8) and (9) are also be sized to provide a sliding fit through first toggle hole (4) and second toggle hole (6). Alternatively, bolts (8) and (9) can be sized to provide an interference fit through first toggle hole (4) and second toggle hole (6). Bolts (8) and (9) can be any form of clasp, pin or shaft, threaded or unthreaded, or partially threaded, so long as bolts (8) and (9) can freely rotate within first breaker holes (5) and second breaker holes (7). Any suitable fastener or terminal structure such as a nut or screw head can be provided on the ends of bolts (8) and (9) to securely maintain bolts (8) and (9) in register with first breaker holes (5) and toggle hole (4), and second breaker holes (7) with toggle hole (6).

Of course, first toggle hole (4) and second toggle hole (6) must be positioned so that adequate clearance is provided between the bottom of the toggle (1) and the top of the space between the pair of 15 ampere breakers. This is to ensure that the toggle (1) allows the breakers to completely open or close. Equally important is the length dimension between first toggle hole (4) and second toggle holes (6), to ensure that first toggle hole (4) axially aligns with first breaker holes (5) at the same time that second toggle hole (5) axially aligns with second toggle holes (6). In this manner, when toggle (1) is secured between the first breakers and the second breakers, the homeowner merely grasps the toggle (1) and simultaneously operates both the first breaker and second breaker. Thus, when the emergency generator is turned to the "on" position, the electrical connection to the outside, utility line is simultaneously turned to the "off" position. The homeowner cannot accidently connect the emergency generator to the utility transmission line, which is especially dangerous should a utility repairman be working on the utility line.

FIG. 2 shows toggle (1) installed between a first breaker (2), through which external electrical power conducts, and second breaker (3), through which the emergency generator provides power to the home. First toggle bolt (8) extends through first toggle hole (4) and axially registers with first breaker holes (5). As seen in FIG. 2, the first breaker (2) is in the "on" position. Second toggle bolt (9) extends through second toggle hole (6), and axially registers with second breaker holes (7). As seen, second breaker (3) is in the "off" position. Because of the length of toggle (1) and the linkage to both first breaker (2) and second breaker (3), it is impossible to have the emergency generator in the "on" position, providing power to the home, and simultaneously have the second breaker (3) in the "on" position, whereby the generator will load the outside utility line with a dangerous current. It must be understood that those loads which are powered by the generator are electrically connected through the generator breaker box at all times, both through the generator toggle (3) and through the external power toggle (2). Because toggle (1) prevents generator toggle (3) and external power transmission toggle (2) from both being in the "on" position simultaneously, the loads connected to the generator cannot be simultaneously connected to the external power source. By way of example, it is desirable to have emergency power generators electrically connected at a minimum to a refrigerator and selected lights. In the case of rural homes a well pump is always connected. The refrigerator, selected lights and pump are connected through the generator panel at all times, both through external toggle (2) and generator toggle (3). Should the external power transmission fail, the user simply operates toggle (1) thereby disconnecting the refrigerator, lights, and pump from the utility transmission through external toggle (2). Because the refrigerator, lights, and pump are also connected through the generator toggle (3), when external toggle (2) is turned to the "off" position, power to the refrigerator, lights, and pump is switched from the external source to the generator simultaneously. At no times can the refrigerator, selected lights, and pump be connected to both the external power transmission and the generator. Of course, those loads that the user does not wish to connect to the generator, such as non-essential lighting, are electrically connected only to the external power transmission through the home panel. As seen in FIGS. 2 and 3, the toggle (3) is dimensioned to fit between the first breaker and the second breaker such that a cover (10) for the breaker box is closable while the toggle is installed.

FIG. 3 shows the generator breaker box in the mode for the emergency generator to power selected loads with the external power disconnected to those selected loads. Toggle (1) is installed between a first breaker (2), through which external electrical power conducts, and second breaker (3), through which the emergency generator provides power to the home. First toggle bolt (8) extends through first toggle hole (4) and axially registers with first breaker holes (5). As seen in FIG. 2, the first breaker (2) is in the "off" position. Second toggle bolt (9) extends through second toggle hole (6), and axially registers with second breaker holes (7). As seen, second breaker (3) is in the "on" position. Because of the length of toggle (1) and the linkage to both first breaker (2) and second breaker (3), it is impossible to have the emergency generator in the "on" position, providing power to the home, and simultaneously have the second breaker (3) in the "on" position, whereby the generator will load the outside utility line with a dangerous current.

To use the toggle (1) according to the instant invention, the toggle (1) is placed between breaker (2) and breaker (3). Toggle bolts (8) and (9) link toggle (1) to breakers (2) and (3). It is most important that when installing toggle (1), breaker (2) is in the "on" position, and breaker "3" is in the off position. Alternatively, when installing toggle (1), breaker (2) can be in the "off" position and breaker (3) is in the "on" position. Toggle (1) when installed in this manner guarantees that breaker (2) and breaker (3) cannot simultaneously be in the "on" position, thereby creating an extremely dangerous condition.

When toggle (1) is properly installed, the power sources for the home can be readily managed in a safe manner. For example, should the homeowner lose power for any reason, he simply flips the emergency generator breaker (2) into the "on" position. Because the positive linkage toggle (1) mechanically links emergency generator breaker (3) and external power breaker (2), all electrical connection to the utility line is safely disconnected. The homeowner cannot unknowingly place a voltage on the external power line and endanger a utility worker. The danger when a homeowner's generator is electrically connected to the external power transmission line cannot be overemphasized. When this occurs, the step-down transformer operates in reverse and steps-up the homeowner's electric generation to extremely dangerous voltages. The instant invention completely eliminates the possibility that the homeowner's generator transmits current over the utility line.

When the homeowner desires to return to the external utility power source, he merely turns the breaker (3) to the "on" position. This simultaneously disconnects or turns off the emergency generator.

The instant toggle of the invention could equally be used to prevent one power source from connecting to two loads. For example, if one power source provides current to either a primary pump or a back-up pump, the toggle could ensure that if the primary pump is turned off, the emergency pump simultaneously turns on. Numerous other examples are possible. It is expressly understood that the toggle according to the invention is not to be limited to emergency generators, but is useful wherever two breakers cannot both be in the same mode at the same time.

The invention claimed is:

1. A first breaker adapted to be connected to an external source of electrical power, and a second breaker adapted to be connected to an electrical generator, wherein the first breaker is in an on position when the second breaker is in an off position, and the first breaker is in an off position when the second breaker is in an on position, in combination with a toggle adapted to simultaneously operate the first breaker and the second bleaker, the first breaker having a first breaker hole, the second breaker having a second breaker hole, where the first breaker electrically connects an external power transmission to a breaker box, and the second breaker electrically connects a generator to the breaker box, the toggle comprising an integral bar with a first toggle hole through the toggle, and a second toggle hole through the toggle, such that the first toggle hole and the second toggle hole are longitudinally spaced whereby the first toggle hole registers with the first breaker hole while the second toggle hole registers with the second breaker hole, including a first bolt extending through both the first toggle hole and the first breaker hole, and a second bolt extending through the second toggle hole and the second breaker hole, such that when the first breaker is turned to an on position, the toggle simultaneously turns the second breaker to an off position, and when the first breaker is turned to an off position, the toggle simultaneously turns the second breaker to an on position and wherein the toggle is dimensioned to fit between the first breaker and the second breaker.

2. The toggle according to claim 1 wherein the toggle is made of metal.

3. The toggle according to claim 1 wherein the toggle is made of a synthetic polymeric material.

4. The toggle according to claim 1 wherein the toggle is dimensioned to fit between the first breaker and the second breaker such that a cover for the breaker box is closable while the toggle is installed.

* * * * *